US008882644B2

(12) United States Patent
Jahns

(10) Patent No.: US 8,882,644 B2
(45) Date of Patent: Nov. 11, 2014

(54) COMPRESSIVE RESISTANCE MEANS AND EXERCISE DEVICE

(76) Inventor: Henner Jahns, Los Angeles, CA (US)

( * ) Notice: Subject to any disclaimer, the term of this patent is extended or adjusted under 35 U.S.C. 154(b) by 131 days.

(21) Appl. No.: 13/504,951

(22) PCT Filed: Nov. 4, 2010

(86) PCT No.: PCT/US2010/055508

§ 371 (c)(1),
(2), (4) Date: Apr. 28, 2012

(87) PCT Pub. No.: WO2011/057013

PCT Pub. Date: May 12, 2011

(65) Prior Publication Data

US 2012/0214650 A1 Aug. 23, 2012

Related U.S. Application Data

(60) Provisional application No. 61/257,840, filed on Nov. 4, 2009.

(51) Int. Cl.

| | |
|---|---|
| ***A63B 21/008*** | (2006.01) |
| ***A63B 21/02*** | (2006.01) |
| ***A63B 23/14*** | (2006.01) |
| ***A63B 23/16*** | (2006.01) |
| ***A63B 21/05*** | (2006.01) |
| ***A63B 21/00*** | (2006.01) |
| ***A63B 23/12*** | (2006.01) |
| ***A63B 21/045*** | (2006.01) |

(52) U.S. Cl.

CPC ..... *A63B 21/023* (2013.01); *A63B 21/05* (2013.01); *A63B 21/00043* (2013.01); *A63B 23/12* (2013.01); *A63B 21/0004* (2013.01); *A63B 21/0455* (2013.01)

USPC ..... 482/111; 482/121; 482/122; 482/44

(58) Field of Classification Search

USPC ..... 482/44–46, 49, 92, 110–113, 121–123, 482/126, 128

See application file for complete search history.

(56) References Cited

U.S. PATENT DOCUMENTS

| | | | | | |
|---|---|---|---|---|---|
| 2,106,994 | A | * | 2/1938 | Chapman | 482/126 |
| 2,683,603 | A | * | 7/1954 | Gackenbach | 473/613 |
| 2,997,300 | A | * | 8/1961 | House | 482/18 |
| 3,075,518 | A | * | 1/1963 | Sellner | 601/24 |
| 3,396,967 | A | * | 8/1968 | Brown | 482/46 |

(Continued)

FOREIGN PATENT DOCUMENTS

| | | | |
|---|---|---|---|
| CN | 2151777 | Y | 1/1994 |
| CN | 2252642 | Y | 4/1997 |

*Primary Examiner* — Stephen Crow
*Assistant Examiner* — Garrett Atkinson
(74) *Attorney, Agent, or Firm* — Aaron P. McGushion

(57) ABSTRACT

An exercise device (10) is provided with a twist cap (14) spaced apart from a base cap (12) with a resistance assembly (52) therebetween. The resistance assembly (52) includes a spring (20), a rotating member (26) that rotates with the twist cap (14), and a translating member (30) threadably engaged to the rotating member (26) and configured to variably deform the spring (20) due to rotation of the twist cap (14) in order to adjust the resistance level. An annularly pleated sidewall (16) and a vent means (18) may be included to provide a further resistance means. The exerciser compresses the twist cap (14) towards the base cap (12) to experience both compressive and bending resistance.

14 Claims, 4 Drawing Sheets

(56) References Cited

U.S. PATENT DOCUMENTS

| | | | | | |
|---|---|---|---|---|---|
| 3,992,004 | A * | 11/1976 | Feron et al. | ..... | 482/128 |
| 4,489,937 | A * | 12/1984 | Kong | ..... | 482/126 |
| 4,613,130 | A * | 9/1986 | Watson | ..... | 482/128 |
| 4,805,899 | A * | 2/1989 | Roehlk | ..... | 482/45 |
| 5,046,726 | A * | 9/1991 | Van Straaten | ..... | 482/125 |
| 5,154,685 | A * | 10/1992 | Chen | ..... | 482/126 |
| 6,652,432 | B2 * | 11/2003 | Smith | ..... | 482/146 |
| 7,625,322 | B1 * | 12/2009 | Krull | ..... | 482/107 |
| 2004/0023766 | A1 * | 2/2004 | Slone | ..... | 482/146 |
| 2004/0214691 | A1 * | 10/2004 | Gottlieb-Myers et al. | ..... | 482/15 |
| 2010/0285931 | A1 * | 11/2010 | Heller | ..... | 482/92 |

* cited by examiner

COMPRESSIVE RESISTANCE MEANS AND EXERCISE DEVICE

CROSS-REFERENCE TO RELATED APPLICATIONS

This application claims the benefit of U.S. Provisional Patent Application 61/257,840 with a filing date of Nov. 4, 2009.

BACKGROUND OF THE INVENTION

Field of Invention

The present invention relates generally to an exercise device and method, and more particularly, to a compressive exercising device and method for use thereof.

Description of the Related Art

Small exercise device that may be compressed by pushing two ends together is known in the art. These devices may use springs or other compressive resistance means to achieve sufficient resistance. However, changing the resistance has been an issue with existing devices. For example, if a coil spring is used as a resistance means, then the user has few options in changing the resistance. Some devices may permit the user to add or remove springs to change the resistance. However, this use often unwieldy and requires removable parts that are easily lost. Some device has relied solely on air or other pneumatic resistance means to provide a resistive force. These devices are often complex and do not provide a large degree of adjustment.

What is needed and not yet provided in the art, is an exercise device that is compact and yet provides a large degree of resistance adjustability. What is also needed is a device that can be created largely of inexpensive materials yet maintains adjustability. Further, what is needed is an exercise device that includes multiple sources of resistance. Yet further, what is needed is an exercise device that not only provides compressive resistance, but also provides bending resistance.

SUMMARY OF THE INVENTION

The present invention provides a unique exercise device that is compact and permits adjustment of the resistance level. The present invention can be made primarily of inexpensive injection molded plastic. Furthermore, the present invention provides up to three separate sources of resistance with adjustability in at least one. Also, the present invention provides the ability to compress and bend in a resistive manner.

The exercise device of the present invention includes a base cap or first end member opposite a twist cap or second end member which is configured to be rotated relative to the base cap. Positioned between the base cap and twist cap is a resistance assembly that provides compressive and bending resistance. The resistance assembly includes a rotating member that rotates with the twist cap either through a direct or indirect connection, and a translating member that is threadably engaged with the rotating member. When the rotating member is rotated by turning the twist cap, the translating member will move a first or second direction depending on the direction of rotation due to their threaded engagement. The translating member is configured to bear down on a spring; and as the translating member moves a first direction it will tend to compress the spring and decompress by movement in the second direction.

As is well known, a spring's resistance varies as a function of the distance it is deformed. When the spring is fully expanded, i.e., not compressed, then the initial force required to compress the exercise device is minimal. As the spring is compressed, the initial force required to further compress the spring by pushing the two ends together is substantially increased. In effect, the spring resistance is changed by changing the degree of initial compression due to the translating member bearing down on the spring. This adjustment permits the exercise device to maintain the same overall size and range of motion while just changing the spring deformation. The user simply rotates the twist cap until the desired resistance level is displayed through the window; then the base cap may be compressed towards the twist cap by overcoming the force of the resistance assembly.

Further, a sidewall may be included that extends from the twist cap to the base cap and fully encloses the resistance assembly. The sidewall preferably is annular, with an increasing diameter towards the edges and decreasing towards the middle, forming a hyperbolic-like or hourglass-shaped cross-section. This cross-sectional shape enhances the ability to provide bending in a resistive manner and to vary the resistance as the sidewall is compressed. Pleats may also be formed in the sidewall to permit controlled deformation. As is well known, the thickness of the sidewall, the size and shape of the pleats, and the material all affect the resistance provided by the sidewall.

To permit air to escape an interior space, a vent may be provided. The vent may be sized to limit the rate of outward or inward air flow to add yet another resistance source.

Figure 1:
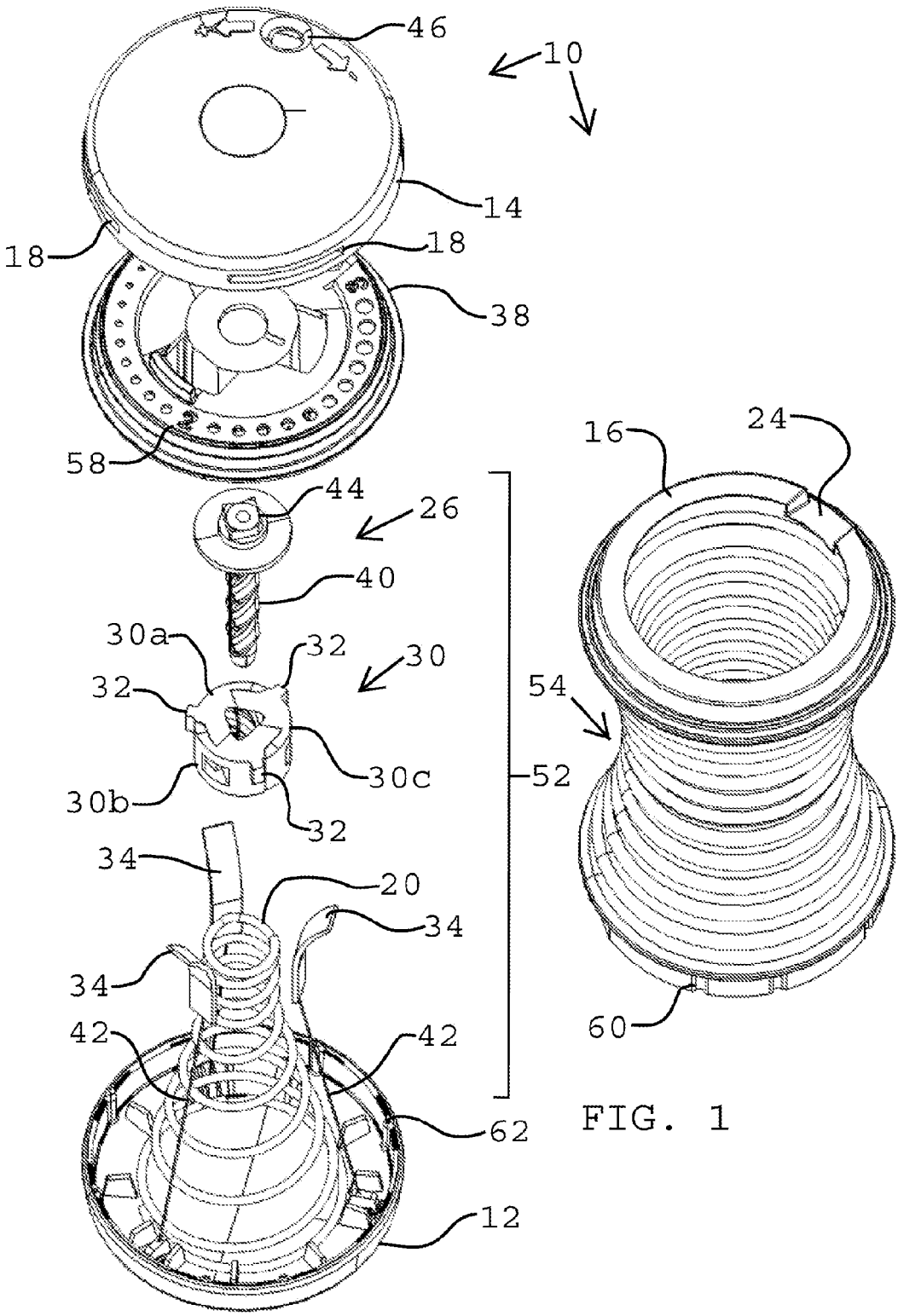
FIG. 1 shows an exploded perspective view of the present invention.

LISTING OF REFERENCE NUMERALS OF FIRST-PREFERRED EMBODIMENT exercise device 10
base cap 12
twist cap 14
sidewall 16
air vent 18
spring 20
guide 22
notch 24
rotating member 26
translating member 30
nut sections 30*a* , 30*b* , 30*c*
tab 32
limiting means 34
slot 36
stationary member 38
male thread 40
cord 42
head 44 window 46
resistance assembly 52
pleats 54
interior space 56
resistance markings 58
notch 60
extension 62

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Looking first at FIG. 1, an embodiment of the exercise device (10) of the present invention can be seen in an exploded view. The twist cap (14) is adjacent to the stationary member (38). The stationary member (38) has a series of resistance markings (58) annularly spaced around the perimeter; these may be numbers or other representative indicia. As the twist cap (14) is rotated by the user the window (46) aligns with one or more resistance markings (58), which corresponds with the degree of compression of the spring (20). The stationary member (38) remains stationary with respect to the base cap (12); and the twist cap (14) may be rotated relative to both. A resistance assembly (52) is situated between the base cap (12) and the twist cap (14) and includes the spring (20), a rotating member (26), and a translating member (30) threadably engaged with the rotating member (26).

In the illustrated embodiment, the rotating member (26) is a screw with threads (40) and a head (44) that engages the twist cap (14) by passing through the stationary member. The translating member (30) in this case is a nut that threads on the screw of the rotating member (26). As the twist cap (14) is rotated, the rotating member (26) is likewise rotated, while the translating member (30) either moves up or down along the rotating member's (26) thread (40). The translating member (30) is designed to either compress of decompress the spring (20) by bearing down on the spring (20). The spring (20) is a conical spring, which has the advantage of increased compression without coil stacking and an increased resistance with deformation as compared to a constant coil diameter. The bottom of the spring (20) is supported by the base cap (12).

The translating member (30) is a nut comprised of several nut sections (30*a*, 30*b*, and 30*c*). Each of the nut sections (30*a*, 30*b*, and 30*c*) interlock to its neighboring section to form a round nut and is identical to its neighbor. The purpose of dividing the nut into sections is to permit the injection molding of each section. Normally, injection molding a nut with internal threads is difficult due to the undercuts. By dividing the nut, all undercuts are essentially eliminated. This allows a relatively inexpensive manufacturing process.

Figure 2:
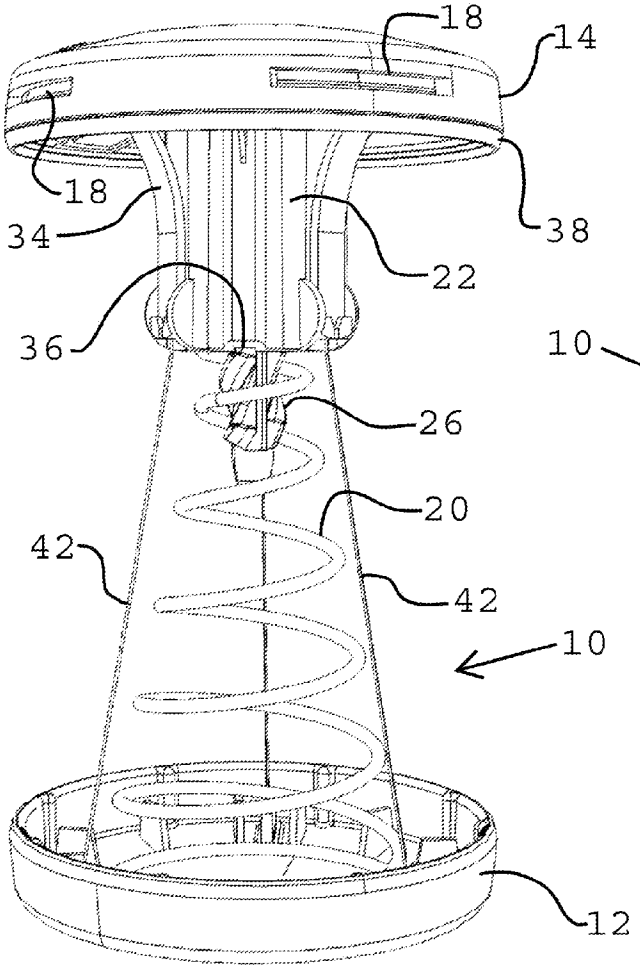
FIG. 2 shows a perspective side view of the present invention without the sidewall.

As can be seen in FIGS. 1 and 2, the stationary member (38) has a guide (22) molded on one side. The guide (22) has at least one slot (36) or other groove-like means that is positioned to engage one or more tabs (32) formed on the exterior of the translating means (30). The tabs (32) ride within the slots (36) to prevent the translating means (30) from rotating, to serve to align the translating means (30) with the spring (20), and to stabilize the rotating member (26) such that it will properly engage the twist cap (14).

It should be noted that the there is no rigid connection between the twist cap (14) and the base cap (12), which permits both compression and bending of the exercise device (10) between the base cap (12) and the twist cap (14). This has the advantage of an enhanced workout that includes a wobble-like motion. Further, the base cap (12) and the twist cap (14) are shaped to permit the gripping of each, one in each hand. Also, the user my place the exercise device (10), for example, between the legs, where the inner thighs grip the base cap (12) and the twist cap (14). In this manner, the base cap (12) and the end cap (14) may be gripped between various body parts or a body part and other external surface, such as a floor, table, or any other support means.

To prevent overexpansion of the exercise device (10), several limiting means (34) are provided. The limiting means (34) preferably connect between the stationary member (38) and the base cap (12), to prevent the spring (20) from pushing the two apart beyond a desired limit. In this example, the limiting means (34) is provided by a cord (42) or other similar flexible connection. The cord (42) has the advantage of preventing overexpansion by providing a tensile force, yet permitting compression of the exercise device (10) without interference.

A sidewall (16) may be included to enclose the resistance assembly (52) and to further provide an additional resistance means. Preferably, the sidewall (16) has a plurality of annular pleats or annular corrugations (54) to permit controlled collapse of the sidewall (16). The sidewall (16) may be injection molded in two parts. Additionally, the sidewall (16) may include a notch (24) that engages the stationary member (38) and a second series of notches (60) that engages a corresponding series of extensions (62) to prevent rotation between the base cap (12) and the stationary member (38). One or more vents (18) are provided in the twist cap (14), although the vents (18) can be formed in a variety of appropriate locations.

Figure 3:
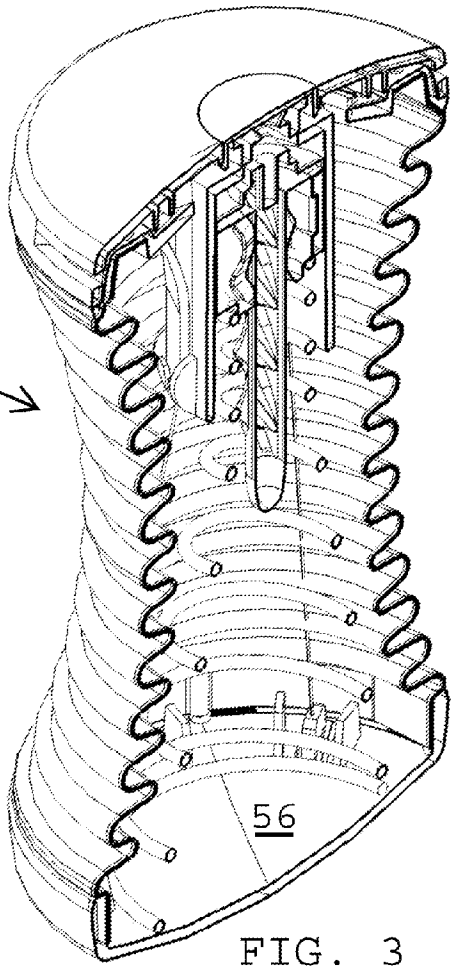
FIG. 3 shows a cross-sectional perspective view of the present invention with the sidewall.

FIG. 3 shows the exercise device in perspective cross-section, with the division shown through a central axis. An interior space (56) is created within the exercise device (10), from which air may be exchanged to or from atmosphere through the vents (18).

Figures 4A, 4B:
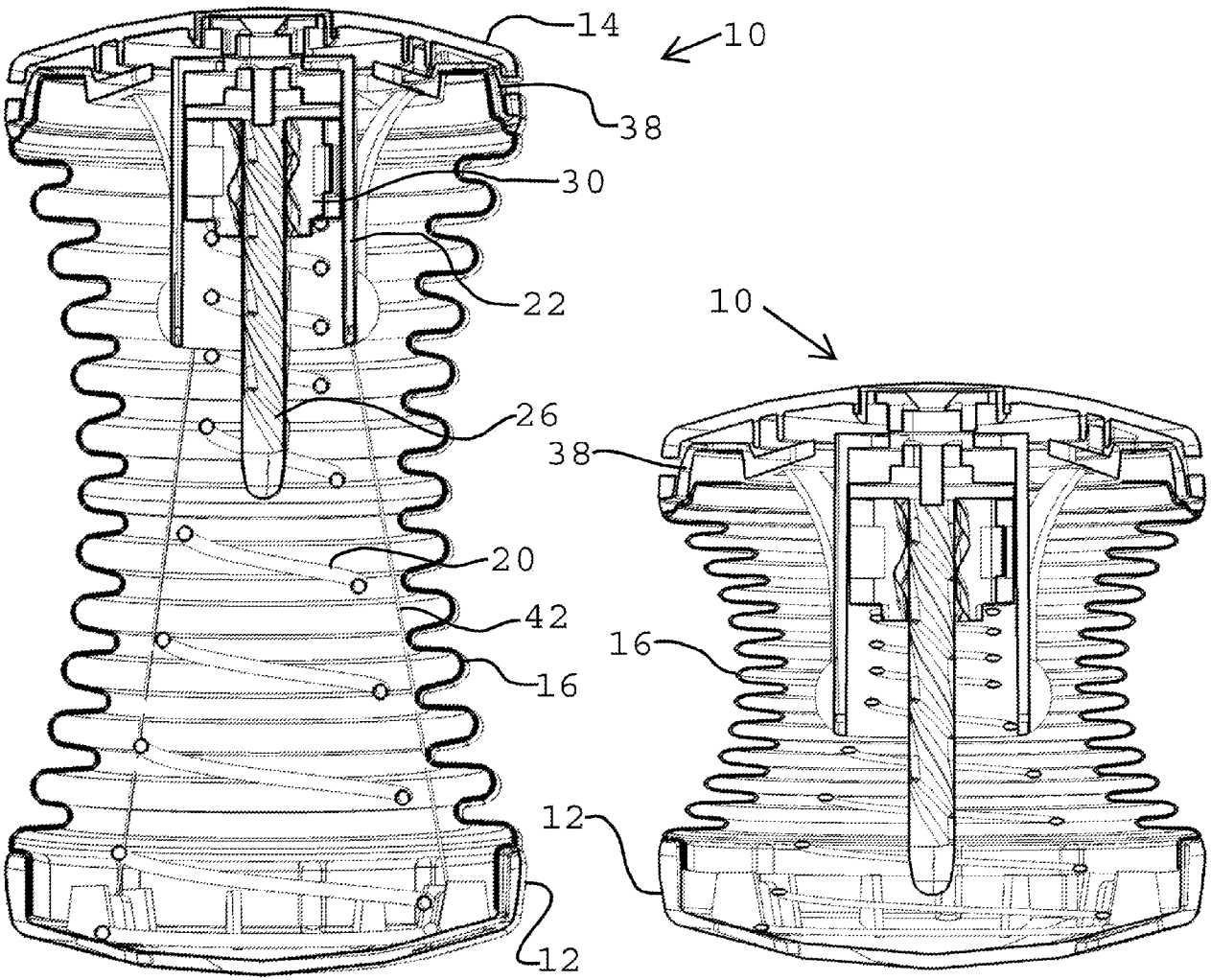
FIG. 4A-B shows a cross-sectional side view of the present invention with the spring fully expanded with the exercise device fully expanded and fully compressed.

Turning to FIGS. 4A-B, the exercise device (10) with the resistance set at the lowest level, due to the spring (20) being fully expanded because the translating member (30) is fully threaded on the rotating member (26), where the translating member (30) is closest to the twist cap (14). FIG. 4B shows the exercise device (10) fully compressed by an unseen user. For example, the user would grasp the twist cap (14) in the right hand and the base cap (12) in the left hand to compress the exercise device (10)

Figure 5B:
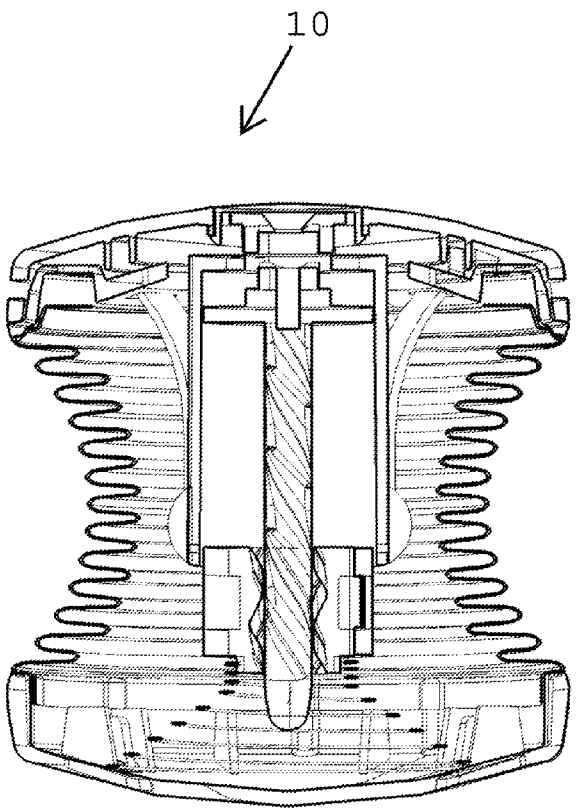
FIG. 5A-B shows a cross-sectional side view of the present invention with the spring compressed by the translating member with the exercise device fully expanded and fully compressed.
Figure 5A:
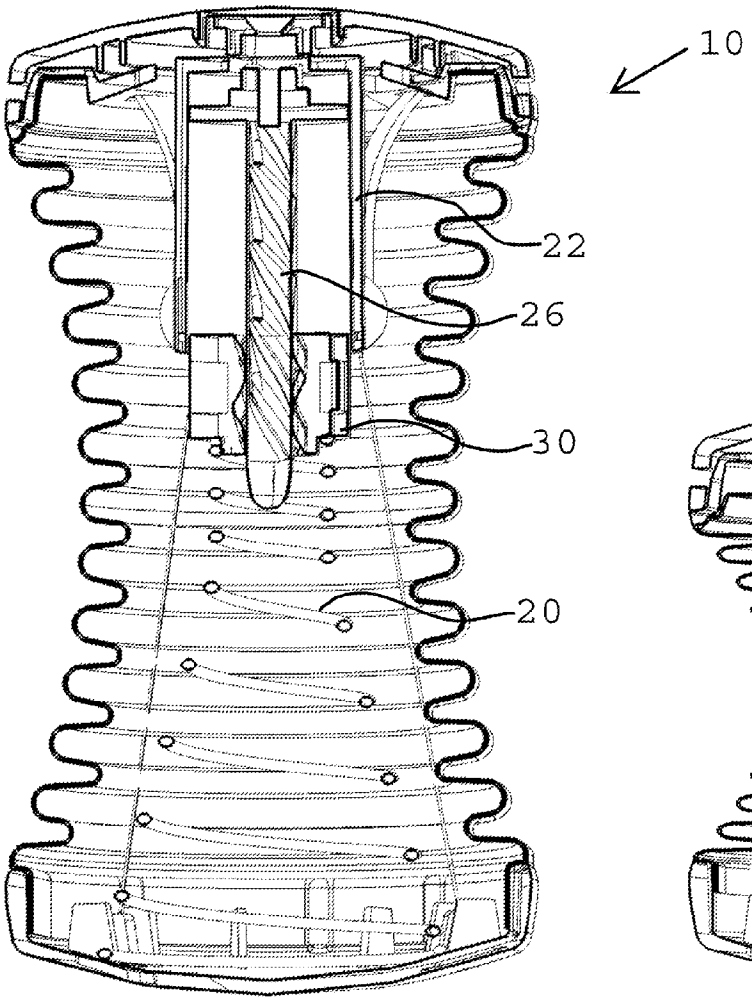

Now referring to FIGS. 5A-B, the resistance level of the exercise device (10) is set to a maximum level, where the spring (20) is compressed to the maximum extent permitted by the travel of the translating member (30), being limited by the thread (40) of the rotating member (26). When comparing FIG. 4B with FIG. 5B, both show the exercise device (10) fully compressed. However, the distance over which the exercise device (10) may be compressed has not changed. This means that, no matter the setting of the resistance assembly (52), the range of motion available to the user does not change. It is only the resistance level that changes.

While particular forms of the invention have been illustrated and described, it will also be apparent to those skilled in the art that various modifications can be made without departing from the spirit and scope of the invention. Accordingly, it is not intended that the invention be limited except by the claims.

What is claimed is:

1. An exercise device, comprising:

a base cap;

a twist cap configured to be rotated relative to the base cap; and a resistance assembly interposed between the base cap and the twist cap, comprising:

a rotating member coupled with the twist cap and configured to rotate with the twist cap;

a translating member threadably engaged with the rotating member and configured to translate upon rotation of the twist cap; and a spring, having a longitudinal axis, spanning between the translating member and the base cap to form a flexible connection between the base cap and the twist cap, the translation of the translating member changing the deformation of the spring for changing a resistance level;

wherein the twist cap is adapted to be rotated to change the resistance level, the base cap and the twist cap are adapted to be pushed together to compress the spring of the resistance assembly, and the base cap and the twist cap are adapted to be torqued relative to each other to bend the spring of the resistance; and wherein a user rotates and bends said device with respect to said longitudinal axis during exercise.

2. The exercise device of claim 1 further comprising a collapsible sidewall extending between the base cap and the twist cap, and enclosing the resistance assembly.

3. The exercise device of claim 2 wherein the collapsible sidewall has a plurality of annular corrugations.

4. The exercise device of claim 2 wherein a cross-sectional diameter of the collapsible sidewall varies, with a minimal cross-sectional diameter near a middle area and a maximum cross-sectional diameter near a first edge and a second edge opposite the first edge.

5. The exercise device of claim 2 further comprising a vent to permit air flow from an interior space formed by the collapsible sidewall.

6. The exercise device of claim 5 wherein the vent is sized to limit airflow from the interior space to provide additional resistance.

7. The exercise device of claim 2 wherein the collapsible sidewall deforms to provide resistance.

8. The exercise device of claim 1 wherein a flexible connection couples the base cap with the twist cap to prevent separation of the base cap and the twist cap, and to permit compression and bending of the resistance assembly.

9. The exercise device of claim 1 wherein the rotating member is a screw and the translating member is a nut.

10. The exercise device of claim 1 further comprising a stationary member adjacent to the twist cap and remaining stationary relative to the base cap, the twist cap having a window formed therethrough, the stationary member having a series of resistance markings sequentially visible through the window as the twist cap is rotated to select the resistance level.

11. The exercise device of claim 10 wherein the rotating member is a screw and the translating member is a nut, a screw head engages the twist cap and passes through the stationary member and into a guide formed on the stationary member, the nut traveling within the guide and being positioned to deform the spring.

12. The exercise device of claim 11 wherein the nut has formed on an outer diameter a tab that is configured to engage a slot formed on the interior of the guide to prevent the rotation of the nut.

13. The exercise device of claim 11 further comprising a vent to permit air flow from the interior space formed by the collapsible sidewall, the vent being sized to limit airflow from the interior space to provide additional resistance.

14. The exercise device of claim 1 wherein the spring is a conical spring.

* * * * *